United States Patent [19]

Rao

[11] Patent Number: 4,755,826

[45] Date of Patent: Jul. 5, 1988

[54] BICOLLIMATED OFFSET GREGORIAN DUAL REFLECTOR ANTENNA SYSTEM

[75] Inventor: Jaganmohan B. L. Rao, Lanham, Md.

[73] Assignee: The United States of America as represented by the Secretary of the Navy, Washington, D.C.

[21] Appl. No.: 456,916

[22] Filed: Jan. 10, 1983

[51] Int. Cl.[4] ..... H01Q 19/17

[52] U.S. Cl. ..... 343/781 P; 343/836

[58] Field of Search ..... 343/779, 835, 781 R, 343/781 P, 781 CA, 837, 839, 840, 836

[56] References Cited

U.S. PATENT DOCUMENTS

| | | | |
|---|---|---|---|
| 3,688,311 | 8/1972 | Salmon | 343/840 |
| 3,995,275 | 11/1976 | Betsudan et al. | 343/781 CA |
| 4,203,105 | 5/1980 | Dragone et al. | 343/781 P |
| 4,223,316 | 9/1980 | Drabowitch | 343/781 P |
| 4,298,877 | 11/1981 | Sletten | 343/781 CA |
| 4,360,815 | 11/1982 | Mizuguchi et al. | 343/781 P |

FOREIGN PATENT DOCUMENTS

| | | | |
|---|---|---|---|
| 116867 | 9/1979 | Japan | 343/781 R |

OTHER PUBLICATIONS

J. B. L. Rao, Bicollimated Near Field Gregorian Reflector Antenna, 1982 APS Symposium Digest, May 24–28, 1982, Albuquerque, N.M., pp. 273–276.

S. P. Morgan, Some Examples of Generalized Cassegrainian and Gregorian Antennas, IEEE Transactions on Antennas and Propagation, AP-12, pp. 685–691, 1964.

C. Dragone and M. J. Gans, Imaging Reflector Arrangements to Form a Scanning Beam Using a Small Array, Bell System Technical Journal, 58, pp. 501–515, 1979.

*Primary Examiner*—William L. Sikes
*Assistant Examiner*—Michael C. Wimer
*Attorney, Agent, or Firm*—Thomas E. McDonnell; Charles S. Guenzer

[57] ABSTRACT

A dual reflector antenna having two reflectors concave to each other and specially shaped so that beams incident on the antenna from two directions are reflected therefrom in collimated beams in two other directions.

7 Claims, 4 Drawing Sheets

BICOLLIMATED OFFSET GREGORIAN DUAL REFLECTOR ANTENNA SYSTEM

FIELD OF THE INVENTION

The invention pertains generally to antennas and more specifically to a dual reflector antenna capable of a large angular scan.

DESCRIPTION OF THE PRIOR ART

Antennas which are required to scan only over relatively small angles are called limited scan antennas. Such antennas are required in some radar systems which must acquire and track a number of targets within a limited angular range. Further applications involve satellite communication systems in which highly directional antennas can be directed to one part of the country in which the intended receiver is located thus conserving power and allowing multiple users for the same radio bands.

For a given aperture antenna, a reflector antenna is much less expensive than a phased array. However, unless the reflector antenna is mechanically rotatable its performance is limited to a very small angular range, defined by its radiation lobes, in order to operate at reasonable power levels. Conversely, a phased array of the same aperture has very wide angular coverage but such large arrays are expensive and difficult to build.

Several workers have attempted to combine a small phased array with a larger reflector to obtain an economical but effective limited scan antenna. Fitzgerald in the Lincoln Laboratory Technical Report No. 486 (1971) entitled "Limited Electronic Scanning with an Offset-Feed Near-Field Gregorian System" describes a dual reflector antenna. A parallel beam originating from a phased array is incident upon a smaller subreflector from which the rays are reflected toward a larger main reflector. After a final reflection from the main reflector the rays together form a larger final beam. The rays in the final beam should be parallel and the length of the various rays as they reflect back and forth should be the same. The final beam rays have phase coherence and form a plane wavefront. In an electronically steerable antenna system, the phased array can emit (or detect) wavefronts over a scanning angle and the final beam will be correspondingly scanned. In Fitzgerald's antenna system each of the reflectors is parabolically shaped, either as parabolic cylinders or paraboloids, with a common focus. The designation of Gregorian refers to both of the reflectors being oriented so they are concave to each other.

Landesman in U.S. Pat. No. 3,500,427 describes a scannable phase array antenna system having a parabolic main reflector and an elliptical subreflector. Dragone et al. in U.S. Pat. No. 4,203,105 describes another such system wherein both the main reflector and the subreflector are parabolic. Further examples of dual reflector antennas are given by Samuel P. Morgan's article in IEEE Transactions on Antenna and Propagation, volume AP-12, pages 685–691, 1964, entitled "Some Examples of Generalized Cassegrainian and Gregorian Antennas".

All of these dual reflector antennas were designed so that the final wavefront is collimated in one direction, i.e. for one direction of parallel rays incident upon the subreflector the corresponding rays reflecting from the main reflector are parallel and in phase. At other directions away from this axis the beam is not collimated and the directionality and phase-coherence of the off-axis beams depends on the details of the reflectors.

The main disadvantage of all these types of dual reflector antennas is their restricted scanning range outside of which the phase errors between the various rays constituting the final wavefront became unacceptably large.

SUMMARY OF THE INVENTION

Therefore it is an object of the invention to provide a dual reflector antenna system for use with a phased array.

It is a further object of the invention to provide an antenna system that can be scanned over large angles.

It is another object of the invention to provide a dual reflector antenna that is collimated in two directions.

The invention is a dual reflector antenna comprising a metallic subreflector and a metallic main reflector. Both reflectors are specially shaped so that beams incident upon the subreflector from two directions are reflected between the reflectors and off the main reflector into two collimated beams in two other directions, i.e, the antenna is bicollimated. A method is provided for calculating discrete points of the central cross-sections of the reflectors. The continuous central cross-sections are smoothly fit to the discrete points. Several 3-dimensional embodiments may be obtained based on the central cross-sections.

DETAILED DESCRIPTION OF THE INVENTION

Figure 1:
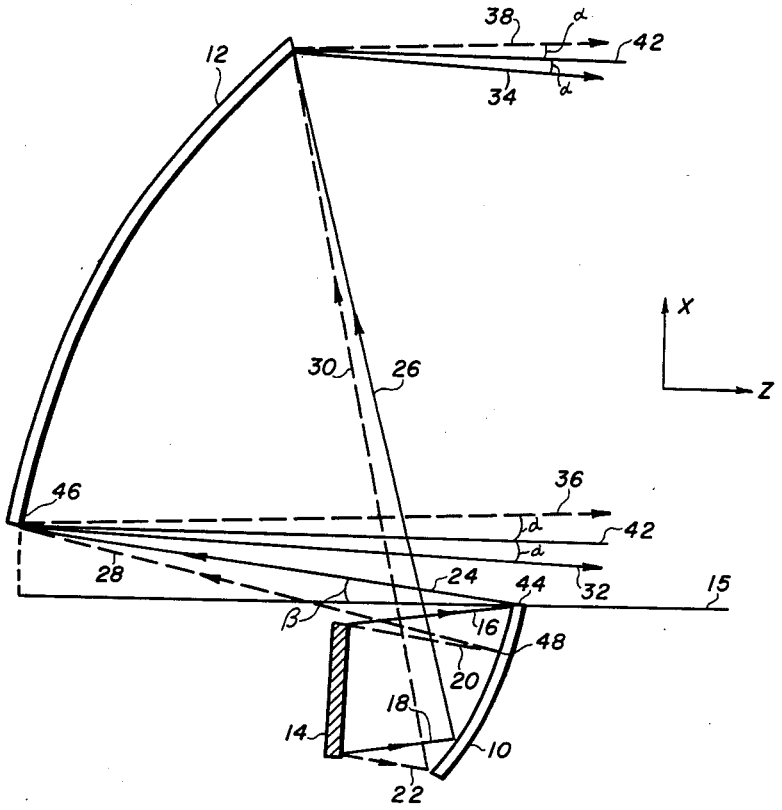
FIG. 1 is a central cross-section illustrating the principle of a bicollimated dual reflector antenna.

Represented in FIG. 1 is a central cross section of the antenna of this invention. The antenna comprises a metallic subreflector 10 and a metallic main reflector 12. Also shown is a phased array 14 composed of multiple transmitting elements. The phased array 14 can radiate a plane wave beam in any dirction over a large scanning range. For instance, a beam can be radiated at an angle $\beta$ with respect to the Z-axis, here chosen to be parallel to the subreflector orientation direction 15. This beam is represented by two initial rays 16 and 18. The phased array is also capable of radiating a beam at an angle $-\beta$ to the same orientation direction as represented by the initial rays 20 and 22.

The antenna of this invention is derived using the approximation of geometrical optics in which a beam is represented as a bundle of rays, each behaving independently. The subreflector 10 and main reflector 12 are constructed of metallic material which cause specular reflection of the rays. The surfaces of the subreflector 10 and main reflector 12 may be solid metal or a metallic mesh or perforated screen having apertures of dimensions less than half the wavelength of the radiation used with the antenna. Within the approximation of geometrical optics, the angle of reflection of a ray equals the angle of incidence as measured from the normal to the surface of the reflector at the point of incidence. This approximation works reasonably well as long as the wavelength of the radiation is much less than the relevant dimensions of the reflectors 10 and 12 so that diffraction effects can be ignored. Within this approximation, each set of the rays 16, 18, 20 and 22 is reflected from the subreflector 10 into corresponding intermediate rays 24, 26, 28 and 30. These intermediate rays are reflected from the main reflector 12 into the corresponding final rays 32, 34, 36 and 38. The final directions are determined by the shapes and locations of the subreflector 10 and main reflector 12.

The invention requires that the subreflector 10 and the main reflector 12 be specially shaped such that the antenna system is bicollimated. This means that all the rays in an initial beam either at $+\beta$ or $-\beta$ with respect to the subreflector orientation direction 15 be reflected between the subreflector 10 and main reflector 12 into a final beam at $-\beta$ or $+\beta$ with respect to the main reflector orientation direction 42. The rays in each of the two initial beams are assumed to be parallel and in phase. The rays in each of the bicollimated final beams must also be parallel and in phase. The in-phase requirement is satisfied if for every ray constituting one of the beams at $+\beta$ or $-\beta$, the ray pathlength between the wavefronts in the initial beam and in the final beam equals a constant L. In other words, the sum of the lengths of the initial ray, the intermediate ray, and the final ray sums to L as measured from a line perpendicular to the initial rays to a line perpendicular to the final rays.

It should be noted that the antenna consisting of the subreflector 10 and main reflector 12 is reciprocal so that it can equally well operate as either a receiving or transmitting antenna. The description of the antenna will assume the conventions appropriate for a transmitting antenna but the resulting antenna can operate as a receiving antenna if the directions of beam propagation are reversed. In addition, although this antenna is particularly useful with a phased array transmitter or a phased array receiver, the invention is not limited to phased arrays and can be used with other types of active elements.

The antenna is shown in central cross-section in FIG. 1. The three-dimensional antenna of this invention can be of any form which contains this central cross-section. One straight forward embodiment produces a quasi-cylindrical antenna which maintains the same cross-section in the direction transverse to the X-Z plane shown in FIG. 1. Alternatively, the central cross-section of both the subreflector 10 and the main reflector 12 can be rotated about central axes parallel to the respective reflector orientation directions 15 and 42. A rotational embodiment will be described more fully in the example. Other three dimensional forms can be obtained which optimize reflection for beams directed out of the X-Z plane.

The three dimensional forms described herein will not be the final configuration of an operational antenna. Additional structure will be required beneath the reflecting surface to provide mechanical support. Furthermore the three dimensional forms need to be truncated in order to minimize blockage, viz., the subreflector 10 intercepting the final rays 32–38 and the main reflector intercepting the initial rays 16–22, as well as to minimize the overall size of the reflectors. Such truncation is performed by ray tracing, especially for the largest desired scanning angles.

The antenna system described heretofore is still quite general. A more specific central cross-sections for such an antenna will be described in an example along with a technique for determining their shape. In this embodiment the reflector orientation directions 15 and 42 of the two reflectors will be parallel, i.e. along the Z-axis. In addition the pathlength L is chosen to be the same for both collimation directions. Also, the subreflector 10 is chosen to be perpendicular to the Z-axis at its highest point 44. These choices allow the reflectors to be rotated about the Z-axis for the 3-dimensional realization and further allow continuous dual reflectors that are not offset but are symmetric about the Z-axis.

With these constraints in mind a procedure can be used to determine the shapes and locations of both the subreflector 10 and the main reflector 12. Bicollimation angles $\alpha$ and $\beta$ are chosen. The ratio of the bicollimation angles gives the magnification factor, $$M=\beta/\alpha \tag{1}$$

The upper bicollimated initial ray 16 reflects from the subreflector 10 at its upper point 44 at an angle $\beta$ with respect to the z-axis. The resulting intermediate ray 24 reflects from the main reflector 12 at its lowest point 46. The slope of the main reflector at its lowest point 46 is determined by the requirement that the corresponding final ray 26 be oriented at $-\alpha$ from the Z-axis. The location of the main reflector's lowest point 46 is determined by the requirement of a total ray-pathlength equalling L.

Once the slope and location of the lowest point 46 on the main reflector 12 is determined, the procedure is reversed by starting with the final ray 36 oriented at $+\alpha$. This ray is required to have reflected from the main reflector's lowest point 46 via a second point 48 on the subreflector 10 and have originated as the initial ray 20 oriented at $-\beta$ relative to the z-axis. The requirements on orientation and total ray pathlength will determine the location and slope of the subreflector's second point 48.

Thereafter the procedure is repeated but using the subreflector's already determined second point 48 as a starting point to determine a second point on the main reflector 12 and a third point on the subreflector. Further repetitions will determine the locations and slopes of a finite sequence of points $(X_K, Z_K)$ on the subreflector 10 and points $(X'_K, Z'_K)$ on the main reflector 12.

Figure 2:
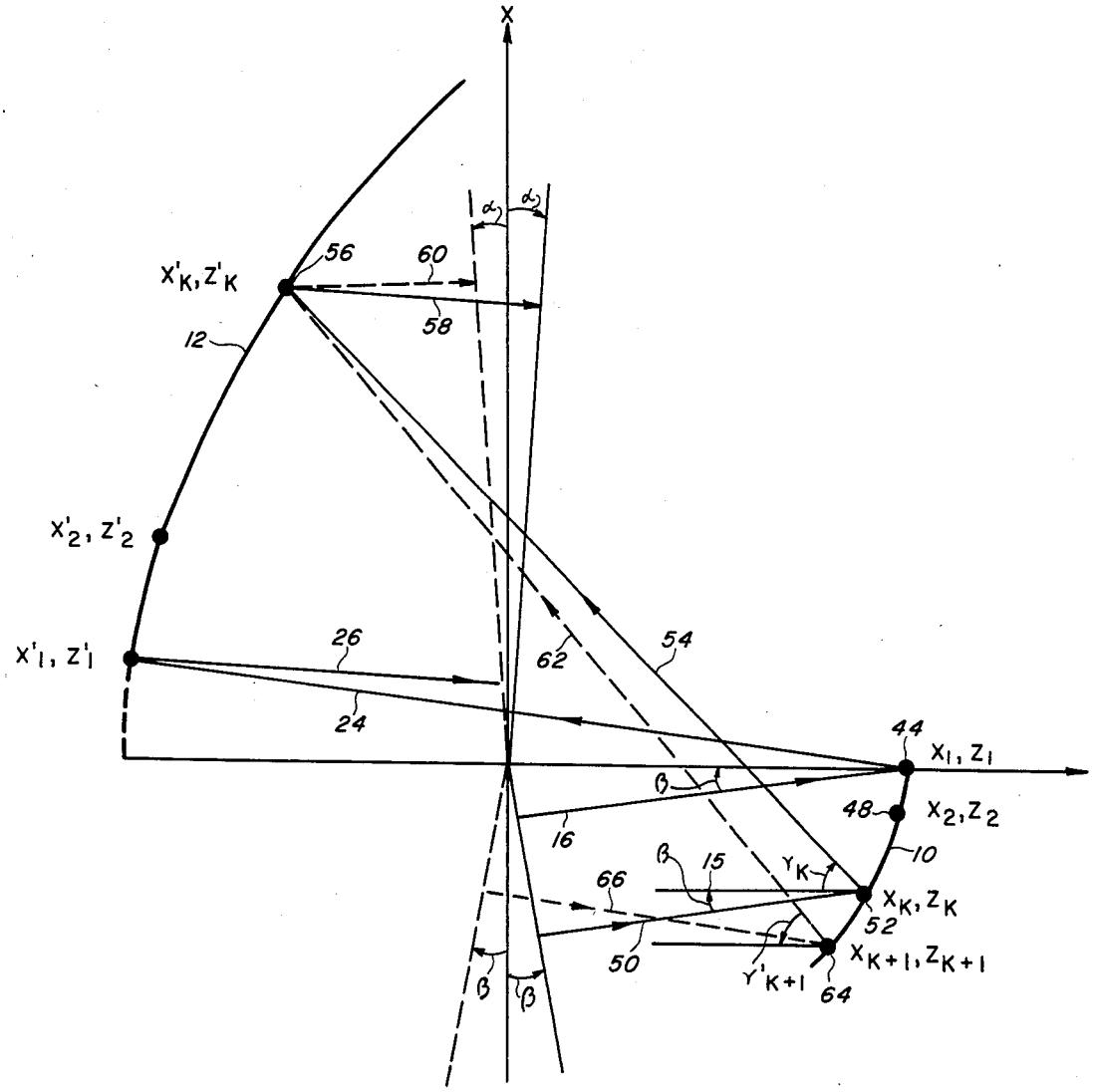
FIG. 2 is a central cross-section of a dual reflector antenna including the rays used to calculate the discrete points of both reflectors.

The mathematical formalism required for this iterative process is hereafter derived based on generalized points on each reflector as shown in central cross-section in FIG. 2. An initial ray 50 oriented at $+\beta$ is incident on the subreflector 10 at a generalized Kth-point 52 having a location $(X_K, Z_K)$ and slope $dX_K/dZ$ that were previously determined. The orientation $\gamma_K$ of the reflected intermediate ray 54 relative to the Z-axis is determined by the geometric optics requirement that the angle of incidence equal the angle of reflection, generally called Snell's law. The intermediate ray 54 is reflected from the K'-th point 56 on the main reflector 12 into a final ray 58 oriented at $-\alpha$ relative to the Z-axis. The total ray-pathlength and Snell's law requirement determines the coordinates $(X'_K, Z'_K)$ of the K'-th point 56 and the slope $dZ'_K/dX'$ of that point. Reversing the procedure for the final ray 60 at $+\alpha$ produces an intermediate ray 62 at an orientation $\gamma'_{K+1}$, reflecting from the K+1-th point 64 on the subreflector and corresponding to an initial ray 66 oriented at $-\beta$. The location ($X_{K+1}$, $Z_{K+1}$) and slope $dZ_{K+1}/dX$ of the K+1-point 64 are thus determined. The mathematical relationships can be shown to be:

$$Z'_K = \frac{R_K - L + Z_K W_K - X_K \sin\alpha}{W_K + \cos\alpha} \quad (2)$$

$$X'_K = X_K + (Z_K - Z'_K)\tan\gamma_K \quad (3)$$

$$dZ'_K/dX' = \tan\left(\frac{\gamma_K + \alpha}{2}\right), \quad (4)$$

$$\gamma_K = \gamma'_K + 2\beta, \quad (5)$$

$$Z_{K+1} = \frac{L - R'_K + Z_K W'_{K+1} + X'_K \sin\beta}{W'_{K+1} + \cos\beta} \quad (6)$$

$$X_{K+1} = X'_K + (Z'_K - Z'_{K+1})\tan\gamma'_{K+1}, \quad (7)$$

$$dZ_{K+1}/dX = \tan\left(\frac{\gamma'_{K+1} + \beta}{2}\right), \quad (8)$$

and $$\gamma'_{K+1} = \gamma K^{+2\alpha} \quad (9)$$

The new variables used in the above equations are given by:

$$R_K = Z_K\cos\beta + X_K\sin\beta, \quad (10)$$

$$W_K = \frac{1 + \sin\gamma_K \sin\alpha}{\cos\gamma_K} \quad (11)$$

$$R'_K = -Z'_K\cos\alpha - X'_K \sin\alpha, \quad (12)$$

and $$W'_{K+1} = \frac{1 + \sin\gamma'_{K+1} \sin\beta}{\cos\gamma'_{K+1}}, \quad (13)$$

The initial values are $X_1=0$, $Z_1=P$, and $\gamma_1=\beta$ from which all the required ($X_K$, $Z_K$) and ($X'_K$, $Z'_K$) can be calculated iteratively.

This procedure was followed for parameters chosen to be $\alpha=3°$, $\beta=9°$, and L/P=2.5. The computed locations normalized to P are given in Table 1.

TABLE 1

COMPUTED POINTS ON THE REFLECTOR CROSS SECTIONS

| K | $Z_K/P$ | $X_K/P$ | $Z'_K/P$ | $X'_K/P$ |
|---|---|---|---|---|
| 1 | 1.000000 | 0 | −0.24342 | 0.196938 |
| 2 | 0.985926 | −0.132464 | −0.154958 | 0.608434 |
| 3 | 0.938416 | −0.276962 | 0.057515 | 1.079506 |
| 4 | 0.836951 | −0.450222 | 0.49982 | 1.678324 |

The above procedure produced only discrete points on both reflectors 10 and 12. A continuous reflector was then approximated by a 4-th order best fit polynomial to the locations listed in Table 1. The polynomials so produced were $$(Z/P)=0.999998-0.8018731(X/P)^2-0.01234972(X/P)^4 \quad (14)$$

and $$(Z'/P)=0.253768+0.26682(X'/P)^2-0.00025741(X'/P)^4 \quad (15)$$

The locus of points for Eqn. 14 gives the central cross section of the subreflector 10 while that for Eqn. 15 determines the main reflector 12.

The slopes, $dZ'_K/dX$ and $dZ'_K/dX$, were not used in determinng the central cross sections of Eqns. 14 and 15. However they could be used in determining continuous central cross sections and their use would be particularly advantageous if the choice of parameters results in relatively few discrete points ($X_K$, $Z_K$) and ($X'_K$, $Z'_K$).

The 3-dimensional forms of the two reflectors 10 and 12 were thereafter obtained in the example by rotating the cross-sections determined by Eqns. 14 and 15 about the Z-axis for which X=0 and Y=0.

Figure 3:
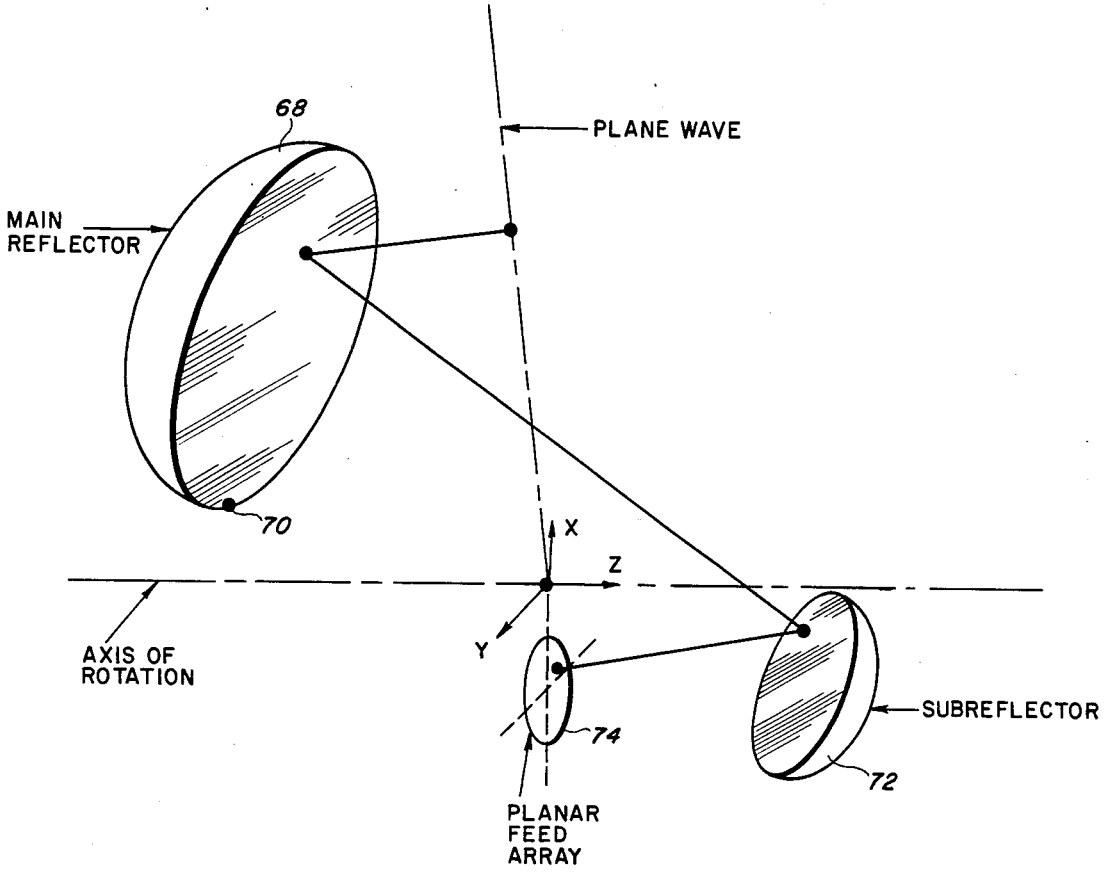
FIG. 3 is a pictorial representation of a 3-dimensional dual reflector antenna having rotational symmetry.

As illustrated in the pictorial representation of FIG. 3, the final 3-dimensional form of the main reflector 68 is set by selecting the portions of the rotated main reflector central cross section which project onto the X-Y plane as a circle of diameter D=1.6P, the lowest point 70 of which is displaced from the Z-axis by 0.3 P. The shapes of the subreflector 72 and planar feed array in the X-Y plane are chosen to fill the main reflector 68 at the maximum scanning angles.

Figure 4:
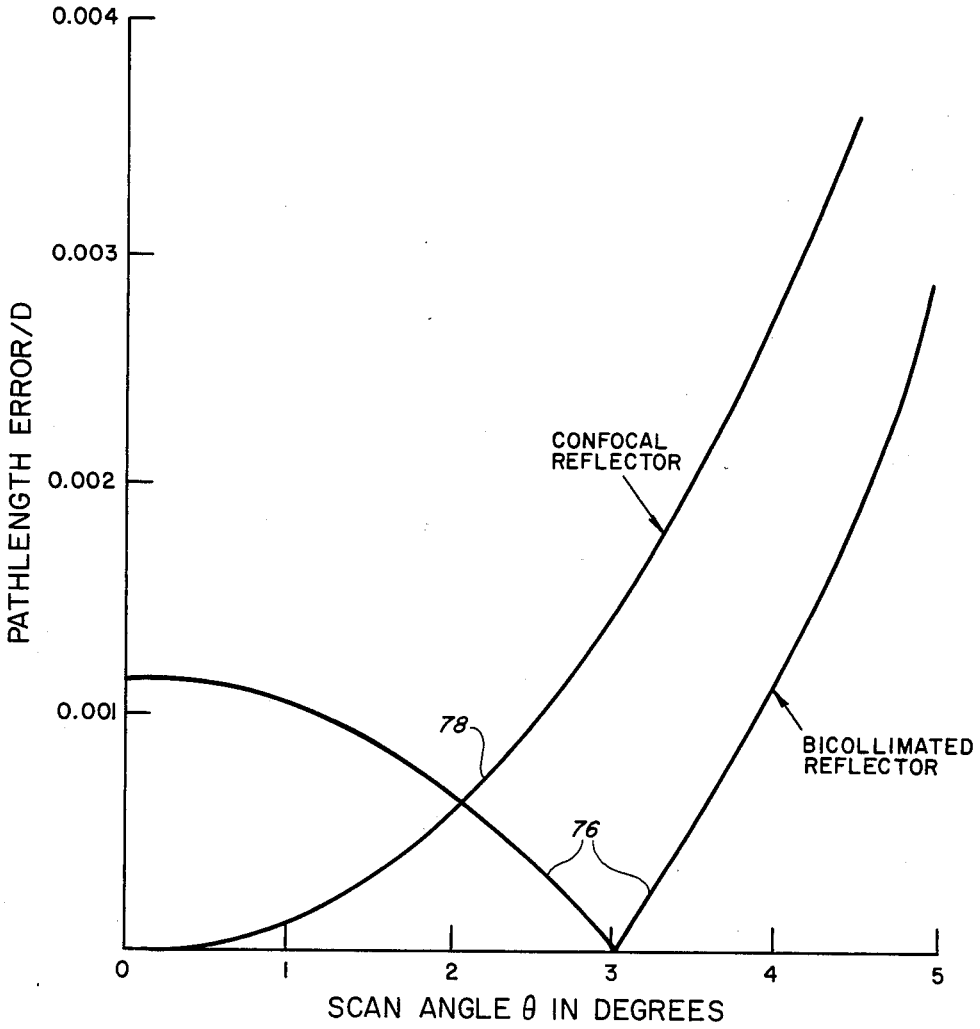
FIG. 4 is a graph representing the calculated phase errors in a bicollimated dual reflector antenna and an equivalent confocal Gregorian antenna.

The performance of an antenna system built according to this example was evaluated by a computer simulation for phase errors as a function of the scanning angle. Individual rays constituting a beam were traced and their pathlengths were compared. The maximum difference in pathlength for a beam provides a measure of the phase error. Curve 76 given in the graph of FIG. 4 gives the error as a function of the scanning angle in the positive x-direction as represented in FIG. 3. The pathlength error is normalized in FIG. 4 by the diameter of the main reflector. It is seen that the pathlength error is zero at 3° which is one of the bicollimated directions. For comparison, similar pathlength error calculations were performed for a confocal Gregorian antenna for which the ratio of focal lengths equals the magnification M of the bicollimated antenna and the sum of the focal lengths equals half the pathlengths L. The confocal pathlength errors are represented by curve 78. It is seen that the confocal pathlength error is zero at 0° which is its single collimated direction but rapidly increases relative to the pathlength errors of the bicollimated antenna. The bicollimated system sacrifices some performance at low scanning angles in order to obtain acceptable performance over a wider scanning angle.

Although the example given involved a set of antennas rotationally symmetric and their cross sections were calculated by an iterative scheme included in the example, it is to be understood that the invention is not limited to such shapes nor is the calculational technique limited to the one provided.

What is claimed as new and desired to be secured by Letters Patent of the United States is:

1. A bicollimated offset gregorian dual reflector antenna system, comprising:

(a) a phased array feed source capable of radiating plane wave beams over a large scanning range;

(b) a metallic subreflector, the central cross section of which smoothly conforms to a first set of points ($X_k$, $Z_k$); and (c) a metallic main reflector, the central cross section of which smoothly conforms to a second set of points ($X'_k$, $Z'_k$);

(d) wherein the central cross sections of said subreflector and said main reflector are concave to each other and of shapes that reflect two initial collimated beams originating from said phase array and incident on the subreflector at two initial collimated directions into two corresponding final collimated beams at two final directions after being reflected from the subreflector to the main reflector and there after reflected from the main reflector;

(e) wherein the central cross sections of said subreflector and main reflector are determined by rays in initial beams incident upon said subreflector from two incident directions and reflected from said main reflector in corresponding two final beams in two final directions, the rays in each incident beam and final beam being parallel within each beam, the pathlength of rays measured from a perpendicular wave front in an incident beam to a perpendicular wave front in the corresponding final beam being a constant, and the rays being reflected from said subreflector and main reflector according to the laws of geometrical optics;

(f) wherein the sets of points are computed from the equations:

$$Z'_k = \frac{R_k - L + Z_k W_k - X_k \mathrm{Sin}\alpha}{W_k + \mathrm{Cos}\alpha}$$

$$X'_k = X_k + (Z_k - Z'_k)\mathrm{Tan}\gamma_k$$
$$\gamma_k = \gamma'_k + 2B$$
$$R_k = Z_k \mathrm{Cos}B + X_k \mathrm{Sin}B$$

$$W_k = \frac{1 + \mathrm{Sin}\gamma_k \mathrm{Sin}\alpha}{\mathrm{Cos}\gamma_k}$$

$$Z_{k+1} = \frac{L - R'_k + Z'_k W'_{k+1} X'_k \mathrm{Sin}B}{W'_{k+1} + \mathrm{Cos}B}$$

$$X_{k+1} = X'_k + (Z'_k - Z'_{k+1})\mathrm{Tan}\gamma'_{k+1}$$

$$\gamma'_{k+1} = \gamma_k + 2\alpha$$
$$R'_k = -Z'_k \mathrm{Cos}\alpha - X'_k \mathrm{Sin}\alpha$$

$$W'_{k+1} = \frac{1 + \mathrm{Sin}\gamma'_{k+1}\mathrm{Sin}B}{\mathrm{Cos}\gamma'_{k+1}}$$

wherein the reflector system is orientated in a right-hand orthogonal x, y, z, axes coordinate system fixed in space with the origin located between the main reflector and the subreflector and the z-axis is positive in the direction toward to the subreflector and perpendicular to the subreflector at its highest point and the x-axis is positive in the direction away from the subreflector; and L is defined as the ray pathlength between the wavefronts in an initial beam and its corresponding final beam;

$\alpha$ is defined as a final bicollimation angle determinative of the scanning range of said dual reflector antenna;

B is defined as an initial bicollimation angle dependent upon the properties of an active element to be used with dual reflector antenna;

$\gamma$ is defined as the orientation of the reflected intermediate ray relative to the z-axis as determined by the geometric optic requirement that the angle of incidence equal the angle of reflection.

2. A bicollimated offset gregorian dual reflector antenna system, as recited in claim 1, wherein the cross sections of said subreflector and main reflector are substantially constant in a direction transverse to the central crosssections.

3. A bicollimated offset gregorian dual reflector antenna system, as recited in claim 1, wherein the central cross-section of the subreflector substantially conforms to a 4th-order polynomial fit to the first set of points ($X_k$, $Z_k$) and the central cross-section of the main reflector substantially conforms to a 4th order polynomial fit to the second set of points ($X'_k$, $Z'_k$).

4. A bicollimated offset gregorian dual reflector system, as recited in claim 1, wherein the central cross-section of both the subreflector and the main reflector rotate about the z-axis.

5. A method of designing a bicollimated offset gregorian dual reflector antenna system, comprising the steps of:

arranging a phased array feed source, capable of radiating plane wave beams over a large scanning range, within a right-hand orthogonal x, y, z, axes coordinate system fixed in space with the z-axis positive in the direction away from a main reflector and perpendicular to a subreflector at its highest point and the x-axis positive in the direction parallel to the main reflector;

locating the feed array in the x—y plane;

selecting a final bicollimation angle $\alpha$, determinative of the scanning range of said dual reflector antenna, an initial bicollimation angle b dependent upon the properties of an active element to be used with said dual reflector antenna, a ray pathlength L for rays in beams collimated at angles $+\alpha$ and $-\alpha$ in the X-Z plane, a location ($X_1$, $Z_1$) for one point of a subreflector, and an orientation angle $\gamma_1$ for the subreflector at the point ($X_1$, $Z_1$); Choosing $X_1=0$, $Z_1=P$, where P is the position of the highest point of the subreflector from the origin of the coordinate system, $\gamma_1=B$; and using geometrical optics calculating a first set of points ($X_k$, $Z_k$) and a second set of points ($X_k'$, $Z_k'$) from the equations:

$$Z_k' = \frac{R_k - L + Z_k W_k - X_k \mathrm{Sin}\alpha}{W_k + \mathrm{Cos}\alpha}$$

$$X'_k = X_k + (Z_k - Z'_k)\,\mathrm{Tan}\gamma_k$$

$$\gamma_k = \gamma'_k + 2B$$

$$R_k = Z_k \mathrm{Cos}\,B + X_k \mathrm{Sin}\,B$$

$$W_k = \frac{1 + \mathrm{Sin}\gamma_k \mathrm{Sin}\alpha}{\mathrm{Cos}_k}$$

$$Z_{k+1} = \frac{L - R'_k + Z'_k W'_{k+1} + X'_k \mathrm{Sin}\,B}{W'_{k+1} + \mathrm{Cos}\,B}$$

$$X_{k+1} = X'_k + (Z'_k Z'_{k+1})\,\mathrm{Tan}\gamma'_{k+1}$$

$$\gamma'_{k+1} = \gamma_k + 2$$

$$R'_k = -Z'_k \mathrm{Cos}\alpha - X'_k \mathrm{Sin}\alpha$$

$$W'_{k+1} = \frac{1 + \mathrm{Sin}\gamma'_{k+1}\,\mathrm{Sin}\,B}{\mathrm{Cos}\gamma'_{k+1}}$$

joining smoothly the first set of points ($X_k$, $Z_k$) to provide a continuous subreflector central cross section;

joining smoothly the second set of points ($X'_k$, $Z'_k$) to provide a continuous main reflector central cross section;

forming a subreflector from metallic material, said subreflector having said continuous subreflector central cross section; and forming a main reflector from metallic material, said main reflector having said continuous main reflector central cross section.

6. A method of designing a bicollimated offset gregorian dual reflector antenna system, as recited in claim 5, further comprising the steps of rotating the continuous central cross section of the subreflector about a subreflector central axis to form a subreflector 3-dimensional cross section and rotating the continuous central cross section of the main reflector about a main reflector central axis to form a main reflector 3-dimensional cross section and wherein the step of forming a subreflector comprises the step of forming a subreflector having said subreflector 3-dimensional cross section and the step of forming a main reflector comprises the step of forming a main reflector having said main reflector 3-dimensional cross section.

7. A method of designing a bicollimated offset gregorian dual reflector antenna system, as recited in claim 5, wherein each step of joining a set of points comprises deriving a 4th-order polynomial fit to each set of points.

* * * * *